United States Patent [19]

Simmons

[11] 4,170,538

[45] Oct. 9, 1979

[54] DIAPHRAGM HAVING ZIRCONIUM AND MAGNESIUM COMPOUNDS IN A POROUS MATRIX

[75] Inventor: Robert B. Simmons, Norton, Ohio

[73] Assignee: PPG Industries, Inc., Pittsburgh, Pa.

[21] Appl. No.: 953,132

[22] Filed: Oct. 20, 1978

[51] Int. Cl.[2] ..... C25B 13/00; C25B 13/04; C25B 13/06; C25B 13/08

[52] U.S. Cl. ..... 204/295; 204/296; 521/27

[58] Field of Search ..... 204/295, 296, 301, 252, 204/253; 521/27, 28

[56] References Cited

U.S. PATENT DOCUMENTS

| | | | |
|---|---|---|---|
| 1,942,183 | 1/1934 | Muller | 204/28 |
| 2,661,288 | 12/1953 | Barbaras | 92/21 |
| 3,056,647 | 10/1962 | Amphlett | 23/14.5 |
| 3,479,266 | 11/1969 | Rajan et al. | 204/295 X |
| 3,479,267 | 11/1969 | Rajan et al. | 204/295 X |
| 3,541,030 | 11/1970 | Boies et al. | 521/27 |
| 3,702,267 | 11/1972 | Grot | 204/295 X |
| 3,703,413 | 11/1972 | Arrance | 136/6 |
| 4,032,427 | 6/1977 | Kadija | 204/295 X |
| 4,089,758 | 5/1978 | McAloon | 204/98 |
| 4,120,772 | 10/1978 | Kadija | 204/295 X |

*Primary Examiner*—Arthur C. Prescott
*Attorney, Agent, or Firm*—Richard M. Goldman

[57] ABSTRACT

Disclosed is a diaphragm having a porous matrix, e.g., a polymeric or asbestos matrix with a layer of magnesium oxide and a hydrous oxide of zirconium therein.

11 Claims, No Drawings

DIAPHRAGM HAVING ZIRCONIUM AND MAGNESIUM COMPOUNDS IN A POROUS MATRIX

Alkali metal chloride brines, such as potassium chloride brines and sodium chloride brines, may be electrolyzed in a diaphragm cell to yield chlorine, hydrogen, and aqueous alkali metal hydroxide. In the diaphragm cell process, brine is fed to the anolyte compartment where chlorine is evolved at the anode. Electrolyte from the anolyte compartment percolates through an electrolyte permeable diaphragm to the catholyte compartment where hydroxyl ions and hydrogen gas are evolved.

Previously, the diaphragm has been provided by fibrous asbestos deposited on an electrolyte permeable cathode. However, environmental and economic considerations now suggest a more longer-lived, less environmentally threatening diaphragm. It is, therefore, necessary to provide either a synthetic fluorocarbon diaphragm a porous ceramic diaphragm, a non-asbestos inorganic fiber or matrix, a treated asbestos diaphragm between the anolyte compartment and the catholyte compartment of the cell.

One particularly satisfactory diaphragm is a porous matrix with a hydrous oxide of zirconium contained within the matrix. This diaphragm may be prepared by contacting, and preferably, saturating a porous body with a zirconium compound and converting the zirconium compound to its oxide, for example, by hydrolysis.

Diaphragms having a zirconium oxide gel surface, layer, or film are difficult to prepare reproducibly. It has now been found that the provision of an effective amount of magnesium, e.g., as magnesium oxide or magnesium hydroxide, provides a reproducible diaphragm. By a reproducible diaphragm is meant a diaphragm having predictable porosity and current efficiency.

Contemplated herein is a diaphragm having a porous matrix and a contained volume of a hydrous oxide of zirconium and magnesium. Additionally, there may also be present wettability enhancing fluorocarbon polymers having pendant acid groups, for example, when the matrix is a hydrophobic fluorocarbon polymer that has been treated with a hydrophilic fluorocarbon polymer.

DETAILED DESCRIPTION OF THE INVENTION

The diaphragm herein contemplated has a matrix with a hydrous oxide of zirconium and a hydrous oxide of magnesium on its internal surfaces and within its pores. The matrix is fabricated of a material that is substantially inert to the electrolyte. Suitable materials of construction include ceramics, inorganic fibers, asbestos fibers and fluorocarbon polymers. The fluorocarbon polymers may be in the form of a fibrous mat or a microporous sheet or film. By fluorocarbon polymers are meant perfluorinated polymers such as polytetrafluoroethylene, poly(fluorinated ethylenepropylene), and poly(perfluoroalkoxies), fluorinated polymers such as polyvinylidene fluoride and polyvinyl fluoride, and chlorofluorocarbon polymers such as chlorotrifluoroethylene and the like. Especially preferred, are the perfluorinated polymers.

The term fluorocarbon polymers also encompasses fluorocarbon polymers having active groups thereon to enhance the wettability of the substrate such as fluorocarbon polymers having sulfonic acid groups, sulfonamide groups, and carboxylic acid groups.

When the fluorocarbon polymer is a porous matrix, for example, either a fibrous mat such as a woven mat or a nonwoven mat, or a microporous membrane, it is desirable to coat the porous matrix with a fluorocarbon resin having pendant active sites thereon. For example, the matrix can be treated with a perfluorinated resin having pendant sulfonic acid groups, pendant sulfonamide groups, pendant carboxylic acid groups, or derivatives thereof.

The matrix may be fibrous, for example, woven fibers, or nonwoven fibers such as felts. The felts may be formed by deposition, for example, by filtration type processes or by needle punch felting processes. Alternatively, the porous mat may be in the form of a sheet or film rendered porous as described in British Pat. No. 1,355,373 to W. L. Gore and Associates for *Porous Materials Derived From Tetrafluoroethylene and Process for Their Production,* or as exemplified by Glasrock "Porex" brand polytetrafluoroethylene films.

The porous sheet or film should have a thickness of from about 10 to about 50 mils and a pore size of from about 0.8 micrometers to about 50 micrometers in diameter and preferably from 2 to about 25 micrometers in diameter with a size of from about 5 to about 20 micrometers being especially preferred. The porosity of the sheet or film is preferably from about 30 to about 90 percent.

The thickness of the porous felt is from about 0.04 inch to about 0.2 inch, and preferably from about 0.05 to about 0.15 inch. The porosity of the porous felt should be from about 30 to about 90 percent.

The internal void volume of the matrix herein contemplated contains hydrous oxides of zirconia and magnesia, that is, gels of zirconia and magnesia. The zirconia gel has the chemical formula $ZrO_2 \times nH_2O$ and the magnesia gel has the chemical formula $MgO \times mH_2O$, where n and m are generally from about 1 to about 8 although substantial excesses of water may be present.

Low loadings of zirconia alone, i.e., below about 0.1 gram per cubic centimeter, result in a diaphragm that is high in permeability and low in current efficiency. Intermediate loadings of zirconia alone, that is, from about 0.1 to about 1.0 gram per cubic centimeter, provide a diaphragm that is high in permeability and low, but improved, in current efficiency relative to low loadings of zirconia alone. Diaphragms that are high in zirconia alone, that is, having a zirconia content above about 1.0 gram per cubic centimeter, have a permeability that is too high. Preferably, the loading of zirconia alone is from about 0.1 to about 1.0 gram per cubic centimeter for a mat having a porosity of about 0.7 to about 0.9.

At loadings of zirconia gel between about 0.1 to about 1.0 gram per cubic centimeter calculated as $ZrO_2$, the presence of MgO in the matrix decreases the permeability of the diaphragm while allowing increased current efficiency.

Magnesia may be an anolyte addition but is preferably incorporated with the zirconium oxychloride in the formation of the hydrous oxide of zirconium. The magnesia is believed to be present in the gel in the form of a hydrated oxide of magnesium having the formula $MgO \times mH_2O$ where m is generally from 2 to 10 although substantial excesses of water may be present.

While the exact role of the magnesia is not clearly understood, it is believed to control permeability, that is, to reduce permeability, i.e., to increase the diaphragm's resistance to fluid flow, without deleteriously affecting current efficiency, while the zirconia modifies the porosity, contains the magnesia in the matrix and enhances wettability. The loading of the magnesia is from about $5\times10^{-3}$ gram per cubic centimeter to about $1.5\times10^{-1}$ gram per cubic centimeter.

In this way, the zirconia to total zirconia and magnesia ratio in the diaphragm is from about 0.30 to about 0.995. Preferably the weight ratio of zirconia to total zirconia and magnesia is from about 0.70 to about 0.995 with a ratio of from about 0.85 to about 0.98 being particularly preferred.

The magnesia and zirconia diaphragm component is believed to be a gel of the hydrated oxides of the zirconium and magnesium where the weight ratio of zirconia to total zirconia and magnesia is from about 0.7 to about 0.995 and preferably from about 0.85 to about 0.98.

The diaphragm herein contemplated, with a porous matrix and a contained volume of hydrous oxides of zirconium and magnesium, is prepared by contacting and preferably saturating the porous matrix with zirconium and magnesium compounds and converting the zirconium and magnesium compounds to the hydrous oxides. According to a preferred exemplification, the oxide gel, that is, the hydrous oxides of zirconium and magnesium, is formed in the matrix by codepositing the precursor compounds. This is accomplished by forming a solution of the precursor compounds, for example, zirconium oxychloride and magnesium chloride, in water. The solution preferably contains up to its solubility limit of zirconium oxychloride, that is, up to about 360 grams per liter of the zirconium oxychloride, and the desired amount of magnesium chloride.

The aqueous solution typically contains from about 4 to about 50 mole percent magnesium, basis total moles of magnesium and zirconium. According to a preferred exemplification, the magnesium is present in the solution as magnesium chloride while the zirconium is present in the solution as zirconium oxychloride. Preferably the solution contains from about 300 to about 360 grams per liter of zirconium oxychloride and from about 20 to about 80 grams per liter of magnesium chloride whereby to provide a mole ratio of about 0.04 moles of magnesium to about 0.5 moles of magnesium to total magnesium and zirconium in the solution.

The porous matrix is saturated with the solution after which the mat is contacted with a base. Preferably the base is a gas, for example, ammonia or anhydrous ammonia, although a liquid such as ammonium hydroxide may be used. The base converts the zirconium oxychloride and magnesium chloride to the hydrous oxides of zirconium and magnesium producing ammonium chloride as a by-product.

The precursors of the hydrous gel coatings can be deposited, preferably to saturate the matrix, in various ways. For example, the solution of the precursor can be brushed or sprayed onto the porous matrix. According to a preferred exemplification, the porous substrate can be immersed in the solution, a vacuum applied to remove air from the matrix, and the solution allowed to penetrate the matrix and preferably fill the void volume with the release of the vacuum.

After hydrolysis, e.g., with ammonia, and formation of the ammonium chloride, the ammonium chloride may be left in the porous mat, for example, to be leached out by the electrolyte. Alternatively, the ammonium chloride may be leached out, the porous matrix partially dehydrated, and addition oxides deposited thereon, that is, additional hydrous oxides of zirconium and magnesium. In this way, total hydrous oxide loadings of up to about 1.5 grams per cubic centimeter may be provided.

The diaphragms of this invention and the diaphragms made according to the method of this invention may be stored, for example, in brine or water, until ready for use.

EXAMPLE I

A diaphragm was prepared by saturating a polytetrafluoroethylene felt matrix with zirconium oxychloride, $ZrOCl_2$, and magnesium chloride, $MgCl_2$, and contacting the matrix with $NH_3$ vapor.

The matrix was a 50 mil thick DuPont ARMALON® XT-2663 poly(tetrafluoroethylene) filter felt matrix having approximately 68 to 70 percent void volume. It was treated with a solution 0.65 weight percent DuPont NAFION® 601 polymer, a perfluorinated polymer having pendant sulfonic acid groups in a solution containing equal amounts of distilled water and ethanol. The polymer was applied to the matrix by laying the mat on a flat glass plate and brushing the solution onto the mat until the mat was saturated. The matrix was allowed to dry in air at 27° C. for 70 minutes followed by heating to 100° C. for 60 minutes, whereby to remove the water and ethanol solvent. The matrix contained 0.96 grams of resin per square foot.

The matrix was then contacted with a solution of zirconium oxychloride, $ZrOCl_2$, and magnesium chloride, $MgCl_2$. The solution was prepared by mixing together solutions of zirconium oxychloride and magnesium chloride.

The zirconium oxychloride solution was prepared by adding PCR, Inc. 99 percent assay $ZrOCl_2\times4H_2O$ to water to obtain a 41 weight percent solution of $ZrOCl_2\times4H_2O$. The magnesium chloride solution was prepared by dissolving 1.67 parts by weight of $MgCl_2\times6H_2O$ in 1 part by weight of distilled water. The solutions were then mixed together to obtain a solution having 1.848 moles per liter of zirconium oxychloride and 0.20 moles per liter of magnesium chloride. The solution had a density of 1.32 grams per cubic centimeter.

The fibrous matrix was then saturated with the solution by inserting the matrix in the solution, drawing a vacuum on the matrix to draw air from the matrix, and releasing the vacuum to allow the solution to penetrate and fill the void volume. The drawing and releasing of the vacuum was continued until there was no further uptake of solution.

The mat was then contacted with $NH_3$ vapor for 18 hours to hydrolyze the chloride, leached in water at room temperature for 72 hours, and stored in brine.

Thereafter, the mat was tested as a diaphragm in a laboratory diaphragm cell. With a 0.16 inch (4.1 millimeter) anode to cathode gap, a ruthenium dioxide coated titanium mesh anode and a perforated steel plate cathode, the head was 9 to 12 inches, the average cell voltage was 3.08 to 3.17 volts at a current density of 190 Amperes per square foot and the cathode current efficiency was 93 percent.

EXAMPLE II

A diaphragm was prepared by saturating a polytetrafluoroethylene felt matrix with zirconium oxychloride, $ZrOCl_2$, and magnesium chloride, $MgCl_2$, and contacting the matrix with $NH_3$ vapor.

The matrix was a 50 mil thick DuPont ARMALON® XT-2663 poly (tetrafluoroethylene) filter felt matrix having approximately 68 to 70 percent void volume. It was treated with a solution 0.65 weight percent DuPont NAFION® 601 polymer, a perfluorinated polymer having pendant sulfonic acid groups, in a solution containing equal amounts of distilled water and ethanol. The polymer was applied to the matrix by laying the mat on a flat glass plate and brushing the solution onto the mat until the mat was saturated. The matrix was allowed to dry in air at 27° C. for 70 minutes followed by heating to 100° C. for 60 minutes, whereby to remove the water and ethanol solvent. The matrix contained 0.96 grams of resin per square foot.

The matrix was then contacted with a solution of zirconium oxychloride, $ZrOCl_2$, and magnesium chloride, $MgCl_2$. The solution was prepared by mixing together solutions of zirconium oxychloride and magnesium chloride.

The zirconium oxychloride solution was prepared by adding PCR, Inc. 99 percent assay $ZrOCl_2 \times 4H_2O$ to water to obtain a 41 weight percent solution of $ZrOCl_2 \times 4H_2O$. The magnesium chloride solution was prepared by dissolving 1.67 parts by weight of $MgCl_2 \times 6H_2O$ in 1 part by weight of distilled water. The solutions were then mixed together to obtain a solution containing 1.709 moles per liter of zirconium oxychloride and 0.49 moles per liter of magnesium chloride. The solution had a density of 1.318 grams per cubic centimeter.

The fibrous matrix was then saturated with the solution by inserting the matrix in the solution, drawing a vacuum on the matrix to draw air from the matrix, and releasing the vacuum to allow the solution to penetrate and fill the void volume. The drawing and releasing of the vacuum was continued until there was no further uptake of solution.

The mat was then contacted with $NH_3$ vapor for 18 hours to hydrolyze the chloride, leached in water at room temperature for 72 hours, and stored in sodium chloride brine.

Thereafter, the mat was tested as a diaphragm in a laboratory diaphragm cell. With a 0.16 inch (4.1 millimeter) anode to cathode gap, a ruthenium dioxide coated titanium mesh anode and a perforated steel plate cathode, the head was 16 to 19 inches, the average cell voltage was 3.07 to 3.10 volts at a current density of 190 Amperes per square foot, and the cathode current efficiency was 93 percent.

While the invention has been described with reference to specific exemplifications and embodiments thereof, the invention is not limited except as in the claims appended hereto.

I claim:

1. In a method of preparing a hydrophilic matrix comprising contacting a porous matrix with a zirconium compound and converting the zirconium compound to a hydrous oxide of zirconium, the improvement comprising depositing a magnesium compound and the zirconium compound in the porous matrix and converting both compounds to oxides.

2. The method of claim 1 comprising codepositing the zirconium compound and the magnesium compound.

3. The method of claim 2 comprising contacting the porous body with an aqueous solution comprising 1 to 30 weight percent Mg, basis total weight of magnesium and zirconium as oxides.

4. The method of claim 2 wherein the Mg is present in the solution as magnesium chloride, the zirconium is present in the solution as zirconium oxychloride, comprising contacting the porous matrix with the aqueous solution of zirconium oxychloride and magnesium chloride, and thereafter contacting the porous matrix with ammonia whereby to hydrolyze the zirconium oxychloride and magnesium chloride.

5. The method of claim 2 wherein the porous matrix is a hydrophobic fluorocarbon.

6. The method of claim 5 comprising depositing a hydrophilic fluorocarbon within the hydrophobic hydrocarbon porous matrix and thereafter codepositing the zirconium and magnesium.

7. The method of claim 2 wherein the porous matrix is an asbestos mat.

8. A diaphragm for a chlor-alkali electrolytic cell comprising:

a porous matrix; and a codeposited film of magnesium oxide and a hydrous oxide of zirconium in said porous matrix.

9. The diaphragm of claim 8 comprising about 1 to 30 weight percent magnesium oxide, basis total magnesium oxide and hydrous oxide of zirconium.

10. The diaphragm of claim 8 wherein the porous matrix is a porous, hydrophobic fluorocarbon.

11. The diaphragm of claim 8 wherein the porous matrix is an asbestos mat.

* * * * *